US005163376A

United States Patent [19]

Frye

[11] Patent Number: 5,163,376

[45] Date of Patent: Nov. 17, 1992

[54] TUBULAR SEAMING SYSTEM

[75] Inventor: Ricky J. Frye, Miamisburg, Ohio

[73] Assignee: MIM Industries, Inc., Miamisburg, Ohio

[21] Appl. No.: 756,172

[22] Filed: Sep. 6, 1991

[51] Int. Cl.[5] ..... D05B 3/00

[52] U.S. Cl. ..... 112/63; 112/121.14; 112/262.2

[58] Field of Search ..... 112/63, 262.2, 121.12, 112/121.14, 121.15, 155, 217.2, 25

[56] References Cited

U.S. PATENT DOCUMENTS

| | | | |
|---|---|---|---|
| 164,241 | 6/1875 | Wheeler . | |
| 278,485 | 5/1883 | Arnold . | |
| 1,222,618 | 4/1917 | Gammons . | |
| 1,387,034 | 8/1921 | Barron et al. . | |
| 1,569,231 | 1/1926 | Mayo . | |
| 1,649,319 | 11/1927 | Molyneux | 112/121.14 |
| 2,223,626 | 12/1940 | Ladue . | |
| 2,630,087 | 3/1953 | Liero et al. . | |
| 2,726,613 | 12/1955 | Eddy . | |
| 3,104,637 | 9/1963 | Hedegaard . | |
| 3,316,869 | 5/1967 | Shelton | 112/25 X |
| 3,428,005 | 2/1969 | Scholl | 112/121.15 |
| 3,664,283 | 5/1972 | McFalls . | |
| 3,664,288 | 5/1972 | Von Boden et al. . | |
| 3,670,675 | 6/1972 | Rovin et al. | 112/121.12 |
| 3,738,292 | 6/1973 | Hintzen et al. | 112/121.14 X |
| 3,799,086 | 3/1974 | Block . | |
| 3,830,175 | 8/1974 | Levor . | |
| 3,875,877 | 4/1975 | Fox . | |
| 3,875,878 | 4/1975 | Kaminski . | |
| 3,970,016 | 7/1976 | Yanikoski . | |
| 4,171,672 | 10/1979 | Dorosz et al. . | |
| 4,174,670 | 11/1979 | Bickhamshaw | 112/25 |
| 4,273,059 | 6/1981 | Kamal | 112/121.14 |
| 4,296,699 | 10/1981 | Vartokian . | |
| 4,305,338 | 12/1981 | Adamson . | |
| 4,455,952 | 6/1984 | Monin et al. . | |
| 4,462,320 | 7/1984 | Scholl . | |
| 4,479,447 | 10/1984 | Rohr | 112/141 |
| 4,493,276 | 1/1985 | Sadeh . | |
| 4,498,407 | 2/1985 | Landwehr et al. . | |
| 4,503,788 | 3/1985 | Giannuzzi et al. . | |
| 4,503,789 | 3/1985 | Scholl | 112/121.14 |
| 4,534,303 | 8/1985 | Off et al. . | |
| 4,592,295 | 6/1986 | Cordier | 112/121.12 X |
| 4,603,647 | 8/1986 | Conley, Jr. et al. . | |
| 4,610,210 | 9/1986 | Kinoshita et al. . | |
| 4,622,907 | 11/1986 | Kimura . | |
| 4,639,964 | 2/1987 | Binder . | |
| 4,664,045 | 5/1987 | Landwehr et al. . | |
| 4,682,551 | 7/1987 | Toman . | |
| 4,685,407 | 8/1987 | Jünemann | 112/63 X |
| 4,696,242 | 9/1987 | Scholl et al. | 112/121.14 |
| 4,708,072 | 11/1987 | Frye . | |
| 4,763,587 | 8/1988 | Frye . | |
| 4,799,438 | 1/1989 | Hinckle | 112/121.12 |
| 4,854,251 | 8/1989 | Hiramatsu et al. . | |
| 4,870,917 | 10/1989 | Frye . | |
| 4,883,006 | 11/1989 | Marii et al. | 12/121.12 |
| 4,920,904 | 5/1990 | Frye . | |
| 4,989,525 | 2/1991 | Portilla . | |
| 5,003,897 | 4/1991 | Yokoe et al. | 112/155 X |
| 5,005,501 | 4/1991 | Kita . | |
| 5,014,633 | 5/1991 | Murata et al. . | |

*Primary Examiner*—Werner H. Schroeder
*Assistant Examiner*—Paul C. Lewis
*Attorney, Agent, or Firm*—Biebel & French

[57] ABSTRACT

A tubular seaming system for stitching workpieces into tubular shapes. The tubular seaming system comprises a sewing head which is pivotally mounted on a support in operative reltionship with a first sewing station and a second sewing station. The first and second sewing stations are angularly displaced at separate points on an arc a predetermined arc length apart. The tubular seaming system comprises a linear motion assembly which is coupled to the sewing head and the support for linearly driving the sewing head into and out of operative relationship with either the first or second workpiece support. The first and second workpiece supports each comprise clamping structure which is capable of clamping overlapping edges of the workpieces so that a master controller can energize the linear motion assembly to drive the sewing head into an operative relationship with either the first or second sewing station so that the workpieces located at the first or second sewing station may be sewn into a tubular shape. The tubular seaming system advantageously permits an operator to sew a plurality of tubular workpieces by loading and clamping one workpiece at one sewing station while another workpiece is being sewn at another sewing station.

31 Claims, 6 Drawing Sheets 14-2
14
45-1
79
48

16
MASTER CONTROLLER
45-1
14-2
79
53
52
14-1
79
48
51
47
47-1
48
59
46
44
49
45
14
38
38-1
22-2

12
14
14-1
14-2

TUBULAR SEAMING SYSTEM

BACKGROUND OF THE INVENTION

1. Field of the Invention

This invention relates to a sewing system, and more particularly, it relates to a sewing system for sewing workpieces into tubular shapes.

2. Description of Related Art

In the sewing industry, it is often necessary to sew a workpiece into a tubular or closed loop shape. To create this tubular shape, two opposing edges of the workpiece would be joined together by overlapping one edge of one side of the workpiece over an edge of the opposing side of the workpiece. The edges of the workpiece would be sewn by hand or manually guided into a sewing machine. After the workpiece was manually guided into the sewing machine, a needle would penetrate both edges of the workpiece so that the two edges were stitched together. Handling the workpiece was often difficult, time consuming, inefficient, and cumbersome. The use of a conventional sewing machine was usually not practical in areas where the stitching to be sewn had to be accurate in its alignment with the edges of the workpiece, even though guides were used on the sewing machines. With the processes of the prior art, manual skill is still required to insert the workpiece and to position it correctly in the sewing machine. In addition, because the operator had to manually feed the workpiece, the operator could typically only sew one workpiece at a time. Thus, sewing each workpiece required the complete attention of the operator which is time consuming and expensive.

There is, therefore, a need to provide a seaming system which accurately sews two edges of a workpiece together and which also permits an operator to load and clamp one workpiece at a sewing station while a second workpiece is being sewn.

SUMMARY OF THE INVENTION

It is therefore an object of the invention to provide a seaming system which enables a tubular workpiece to be sewn at a first sewing station while a second workpiece is being loaded at a second station.

In one aspect, this invention comprises a sewing system comprising: a pivotable sewing head; a first sewing station; a second sewing station; said first and second sewing stations being angularly displaced at separate points on an arc a predetermined arc length apart; a support for supporting said pivotable sewing head in operative relationship with said first and second sewing stations; positioning means secured to said support for pivoting said pivotable sewing head and also for causing relative movement between said pivotable sewing head and said first and second sewing stations so that said pivotable sewing head becomes operatively positioned at either said first sewing station or said second sewing station; and a master controller coupled to said pivotable sewing head and said positioning means, said master controller being capable of energizing said positioning means to cause said pivotable sewing head to be pivoted towards either said first or second sewing station and positioned at either said first sewing station or said second sewing station so that workpieces located at said first or second sewing stations, respectively, may be sewn.

Another object of this invention is to provide a sewing system which comprises a generally V-shaped frame having an intersection point at which a sewing head is pivotally mounted so that the sewing head can pivot along a predetermined arc towards either a first sewing station located on a first leg of the V-shaped frame or a second sewing station located on a second leg of the V-shaped frame.

Another object of this invention is to provide a sewing system which permits an operator to quickly and easily load a workpiece at a sewing station.

Still another object of this invention is to provide a sewing system having a linear motion assembly for enabling a sewing head to linearly move towards either a first sewing station or a second sewing station after the sewing head has been pivoted into alignment with the first or second sewing station, respectively.

These objects, and others, may be more readily understood in connection with the following specification, claims, and drawings.

DESCRIPTION OF THE PREFERRED EMBODIMENT

Figure 1:
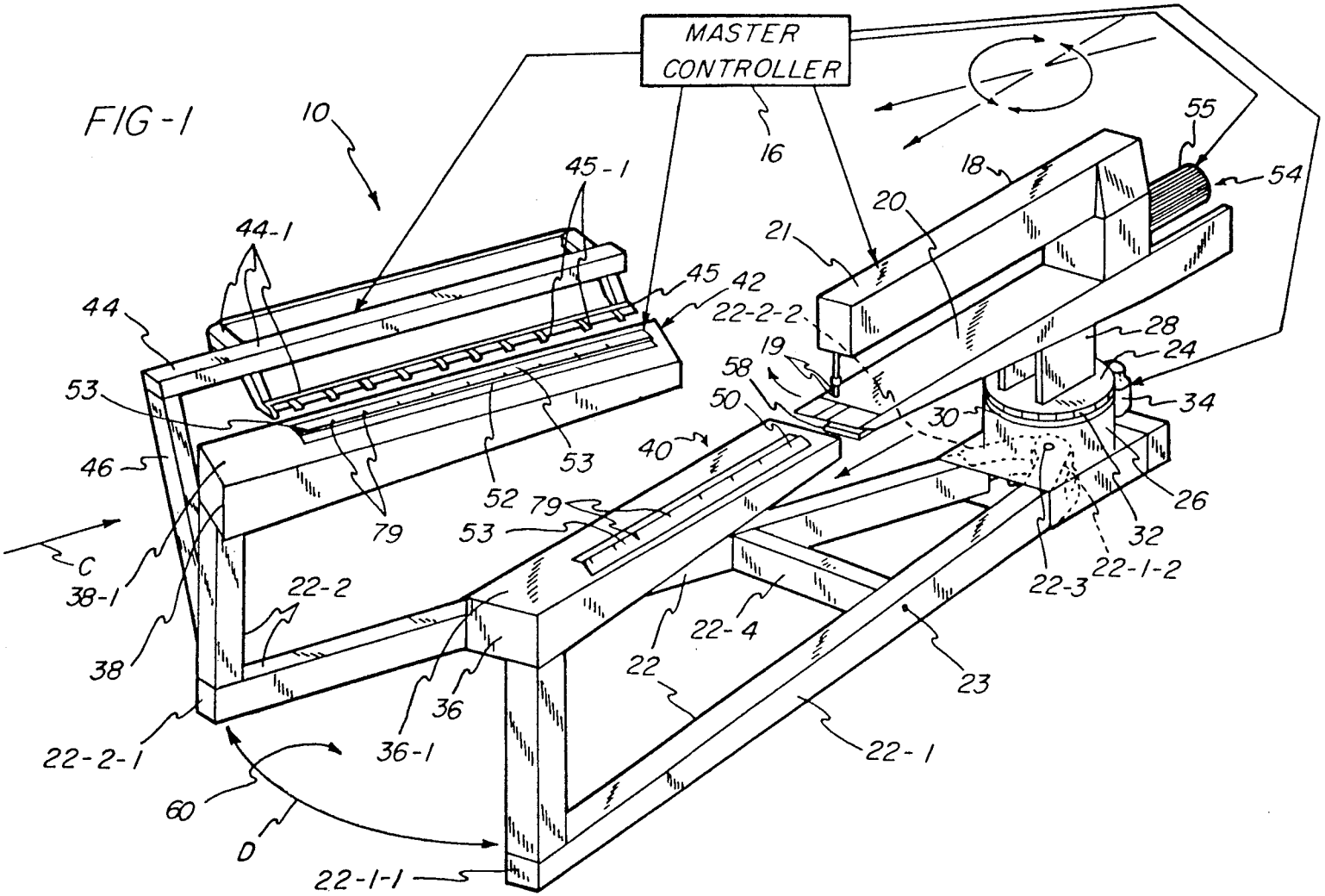
FIG. 1 is a perspective view of a sewing system according to one embodiment of this invention.
Figures 5A, 5B:
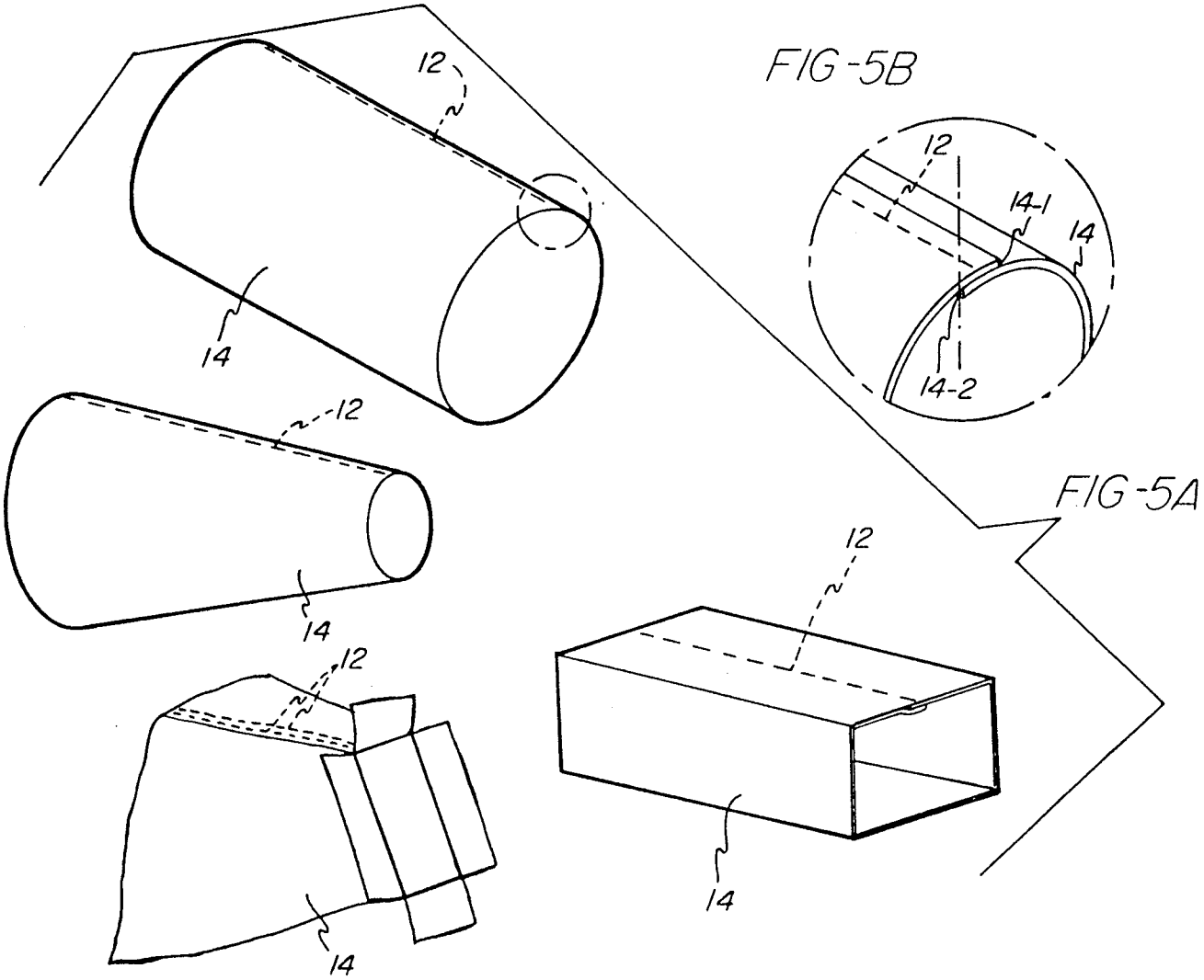
FIG. 5A shows various shaped tubular workpieces which may be sewn with the present invention.
FIG. 5B is an exploded view of a portion of one of the tubular workpieces shown in FIG. 5A.

FIG. 1 shows a perspective view of a sewing system, hereinafter designated as sewing system 10, according to the present invention. The function of the sewing system 10 is to sew a predetermined stitch pattern 12 (FIGS. 5A and 5B) on a workpiece 14, according to a computer program (not shown) which is controlled by a master controller 16 (FIG. 1). In the embodiment being described, the predetermined stitch pattern 12 is typically 30 inches long. The sewing system 10 comprises a sewing head 18 having a base 20 and a horizontal arm 21 which extends out over the base 20. A suitable sewing head 18 may be the Brother BAS Model 361 which is manufactured by Brother Industries of Japan.

The sewing system 10 comprises a support or generally V-shaped frame 22 having a first leg portion 22-1, a second leg portion 22-2, and an intersecting point 22-3 for pivotally joining the ends of the first and second leg portions 22-1 and 22-2. In the embodiment being described, the generally V-shaped frame 22 may have a detachable support member 22-4 secured therebetween by suitable fasteners, such as screws 23. The support member 22-4 facilitates securing the first and second leg portions together so that the ends 22-1-1 and 22-2-1 are angularly displaced on an imaginary arc a predetermined arc length apart (indicated by double arrow D in FIG. 1). The arc faces a focal or imaginary point associated with the sewing head 18 and the intersection point 22-3. The first and second leg portions 22-1 and 22-2 have ends 22-1-2 and 22-2-2 (shown in phantom in FIG. 1) which are opposite the ends 22-1-1 and 22-2-1 and which are also adjustably and pivotally secured together, for example, by conventional means, such as a hinge (not shown), pivot pin coupling (not shown) or any other suitable means for pivotally coupling the first leg portion 22-1 to the second leg portion 22-2. This pivotal coupling permits the predetermined arc length D to be changed or adjusted by pivoting the ends 22-1-1 and 22-2-1 towards and away from each other. In the embodiment being described, it may be desirable to fix the predetermined arc length D by securing the support member 22-4 between the first and second leg portions 22-1 and 22-2 as shown in FIG. 1. In the embodiment being described, the first and second leg portions 22-1 and 22-2 are secured together so that the predetermined arc length D is approximately 60° . If it is desired to increase or decrease the predetermined arc length D, then a longer or shorter, respectively, support member 22-4 could be used. In addition, the program (not shown) in the master controller 16 would be programmed to reflect the new predetermined arc length D so that the sewing head 18 will be pivoted into proper alignment with the first and second leg portions 22-1 and 22-2.

The seaming system 10 also comprises a first workpiece support 36 (FIG. 1) located on the first leg portion 22-1 and a second workpiece support 38 located on the second leg portion 22-2. The first workpiece support 36 has a first elongated slot 50, and the second workpiece support 38 has a second elongated slot 52. The first and second workpiece supports 36 and 38 provide a first sewing station 40 and a second sewing station 42 which permit the workpieces 14 to be sewn in tubular shapes in the manner described later herein. The first and second elongated slots 50 and 52 permit a pair of sewing needles 19 from the sewing head 18 (FIG. 1) to pass therethrough so that the predetermined stitch pattern 12 (FIGS. 5A and 5B) can be sewn on the workpiece 14 when the sewing head 18 is moved into an operative position at the first and second sewing station 40 and 42, respectively. In the embodiment being described, the elongated slot is approximately 32 inches long and 1 inch wide.

Figures 4A, 4B:
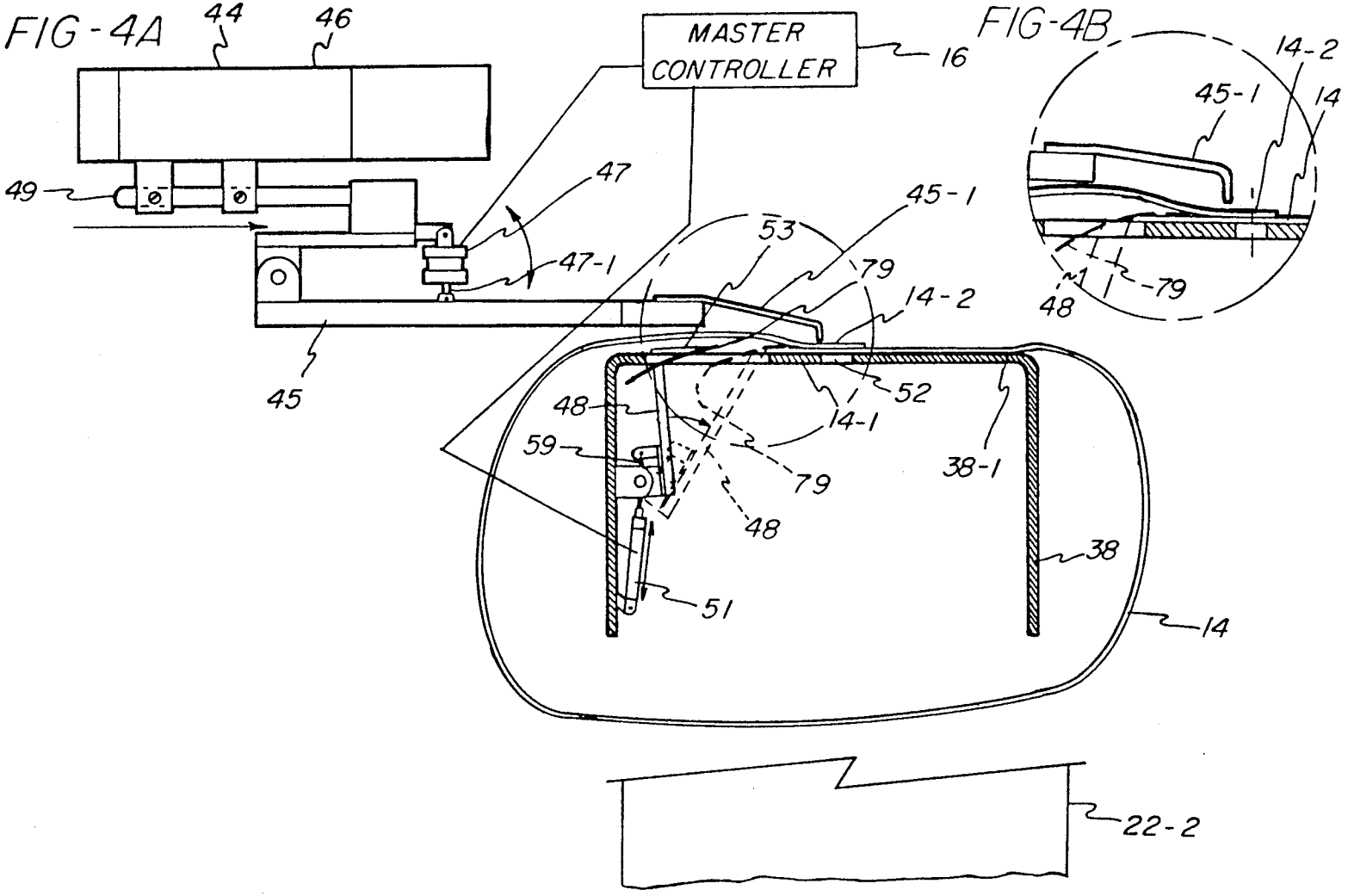
FIG. 4A is a fragmentary view partly in section, taken in the direction of arrow C in FIG. 1, showing details of means for clamping a workpiece.
FIG. 4B is an exploded view of a portion of the clamping means shown in FIG. 4A.

The first and second workpiece supports 36 and 38 each comprise clamping means 44 (FIGS. 1 and 4A) for clamping two edges of the workpiece 14 against either the first or second workpiece supports 36 and 38, respectively, so that the sewing head 18 can sew the two edges together with the predetermined stitch pattern 12 (FIG. 5). The clamping means 44 (FIG. 4A) will be described in relation to the second workpiece support 38. For ease of illustration, the overhead clamping structure 44-1 (FIG. 1) is only shown in association with the second workpiece support 38, but it should be appreciated that an identical overhead clamping structure 44-1 is also associated with the first workpiece support 36. An adjustable arm 49 (FIG. 4A) is adjustably secured to a bracket 46. As best shown in FIG. 1, the bracket 46 is conventionally secured to the first workpiece support 38, for example, by a weld or by suitable nuts (not shown) and bolts (not shown). The adjustable arm 49 is also pivotally coupled to a finger bar 45 having a plurality of resilient fingers 45-1 secured thereto. The clamping means 44 also comprises a cylinder 47 having a solenoid 47-1 which is coupled between the adjustable arm 49 and the finger bar 45 as shown. The solenoid 47 is capable of forcing the fingers 45-1 on the finger bar 45 against one or more edges 14-1 and 14-2 of the workpiece 14 and also against the clamping surface 38-1 of the second workpiece support 38. As best shown in FIGS. 4A and 4B, the clamping means 44 also comprises a clamp bar 48 having a plurality of fingers 79 secured thereto and a solenoid 51 which is mounted underneath the support surface 38-1 of the second workpiece support 38. The solenoid 51 comprises an armature 59 which is pivotally coupled to the clamp bar 48. The solenoid 51 can be energized by the master controller 16 to cause the fingers 79 to pivot through slots (not shown) in a bump gauge 53 in order to secure an end 14-1 of the workpiece 14 against the support surface 38-1, as shown in phantom in FIGS. 4A and 4B. The master controller can then energize solenoid 47 to cause the fingers 45-1 to engage the second edge 14-2 and force the second edge 14-2 against the first edge 14-1 and also against the support surface 38-1. In the embodiment being described, the master controller 16 energizes the solenoid 51 to retract the fingers 79 to a non-engaged position (shown in FIGS. 1 and 4A). The clamping means 44 could include the structure shown and described herein or could include any other suitable means for clamping the workpiece 14 against the first and second workpiece supports 36 and 38.

Figure 2:
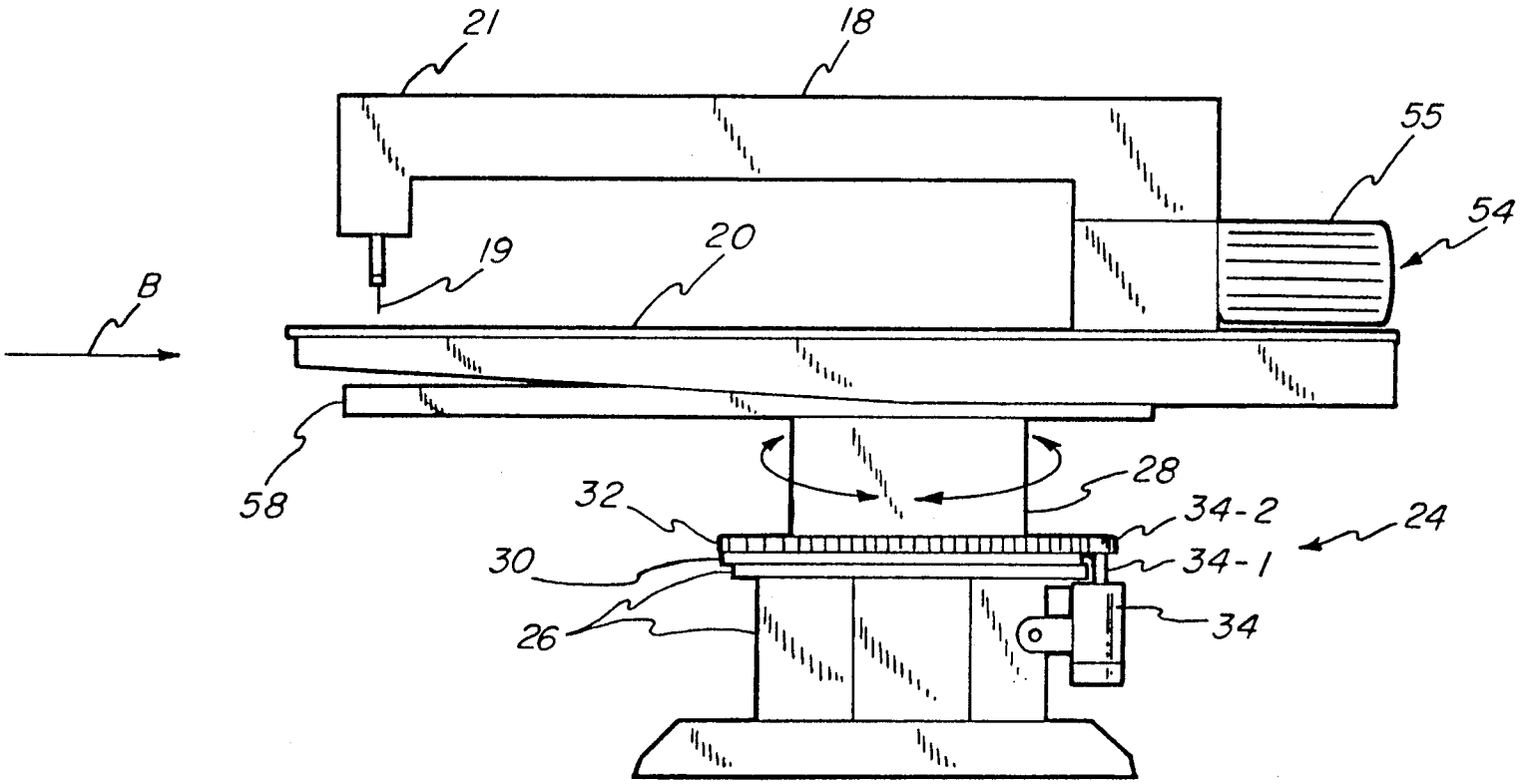
FIG. 2 is a fragmentary side view, taken in the direction of arrow A in FIG. 1, showing means for pivoting a sewing head.

The sewing system 10 also comprises positioning means for causing relative movement between the sewing head 18 and the first and second leg portions 22-1 and 22-2 so that the sewing head 18 becomes operatively positioned at either the first sewing station 40 or the second sewing station 42. The positioning means comprises pivot means 24 and moving or drive means 54. As best shown in FIG. 2, the pivot means 24 comprises a bottom member 26 located at the intersecting point 22-3 of the V-shaped frame 22. The pivot means 24 also comprises a top member 28 which is pivotally and rotatably mounted on the bottom member 26 with a thrust bearing coupling 30. The top member 28 is generally cylindrical and has a motor drive gear 32 thereround. The pivot means 24 also comprises a servo motor 34 which is conventionally coupled to the bottom member 26. The servo motor 34 has a drive shaft 34-1 and a drive gear 34-2 which engages and cooperates with the motor drive gear 32 to pivot or rotate the top member 28 and the sewing head 18. The pivot means 24 described herein could include any other means for permitting the sewing head 18 to pivot on a predetermined arc of 360° or less.

Figure 3:
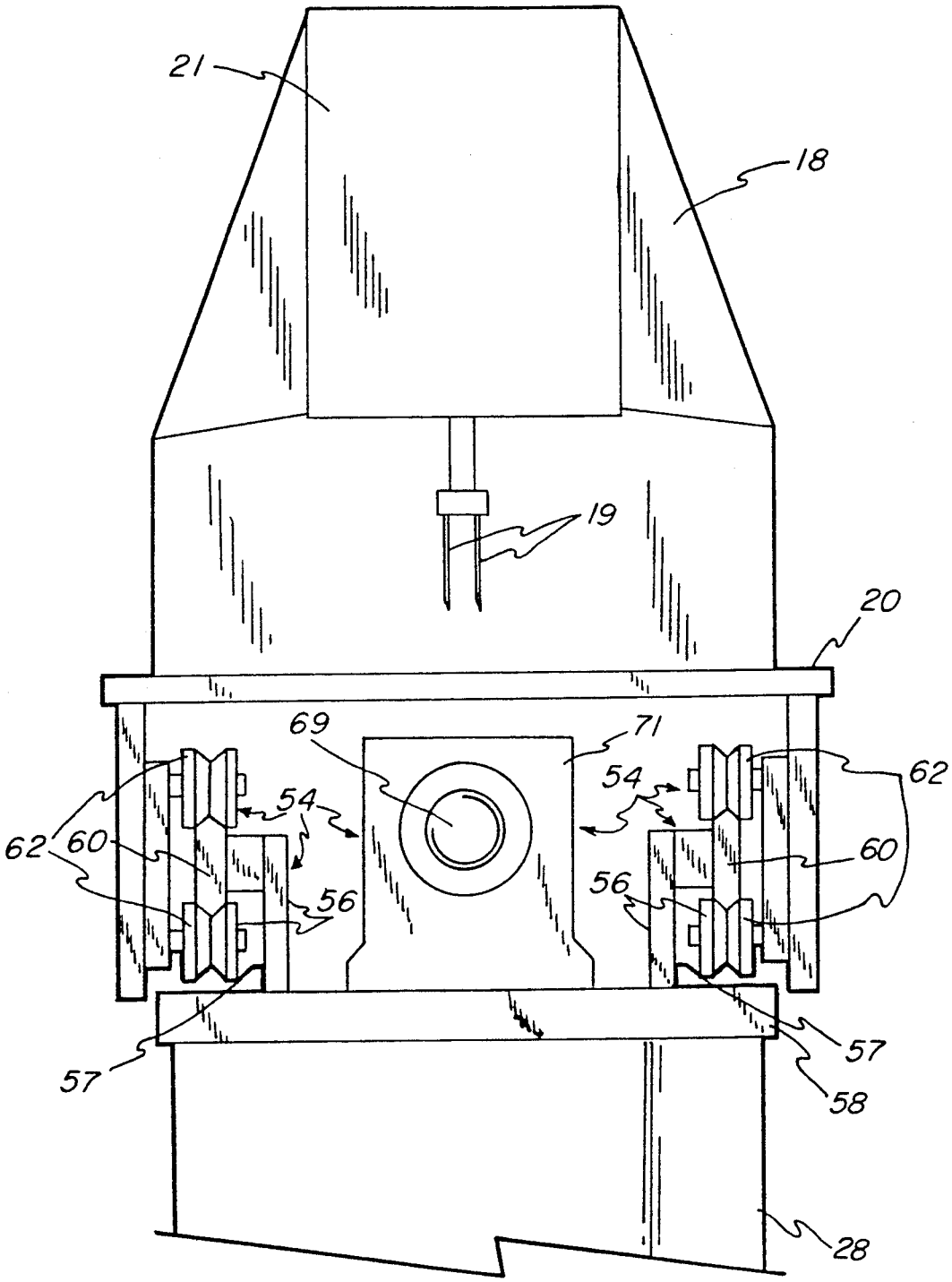
FIG. 3 is a view, taken in a direction of arrow B in FIG. 2, showing details of a linear motion assembly for driving the sewing head towards and away from the first and second sewing stations.

As best shown in FIG. 3, the positioning means in the sewing system 10 also comprises moving or drive means 54 which couples the sewing head 18 to the top member 28 of pivot means 24. The function of the drive means 54 is to move the sewing head 18 from a home position (shown in FIG. 1) to a sewing position where the horizontal arm becomes operatively related to either the first workpiece support 36 at the first sewing station 40 or the second workpiece support 38 at the second sewing station 42. As best shown in FIG. 3, drive means 54 comprises a linear motion assembly 56. The linear motion assembly 56 comprises a pair of guide rails 60 which are conventionally secured to a planar member 58 by brackets 57. The planar member 58 is conventionally coupled to the top member 28 of pivot means 24.

Figure 6:
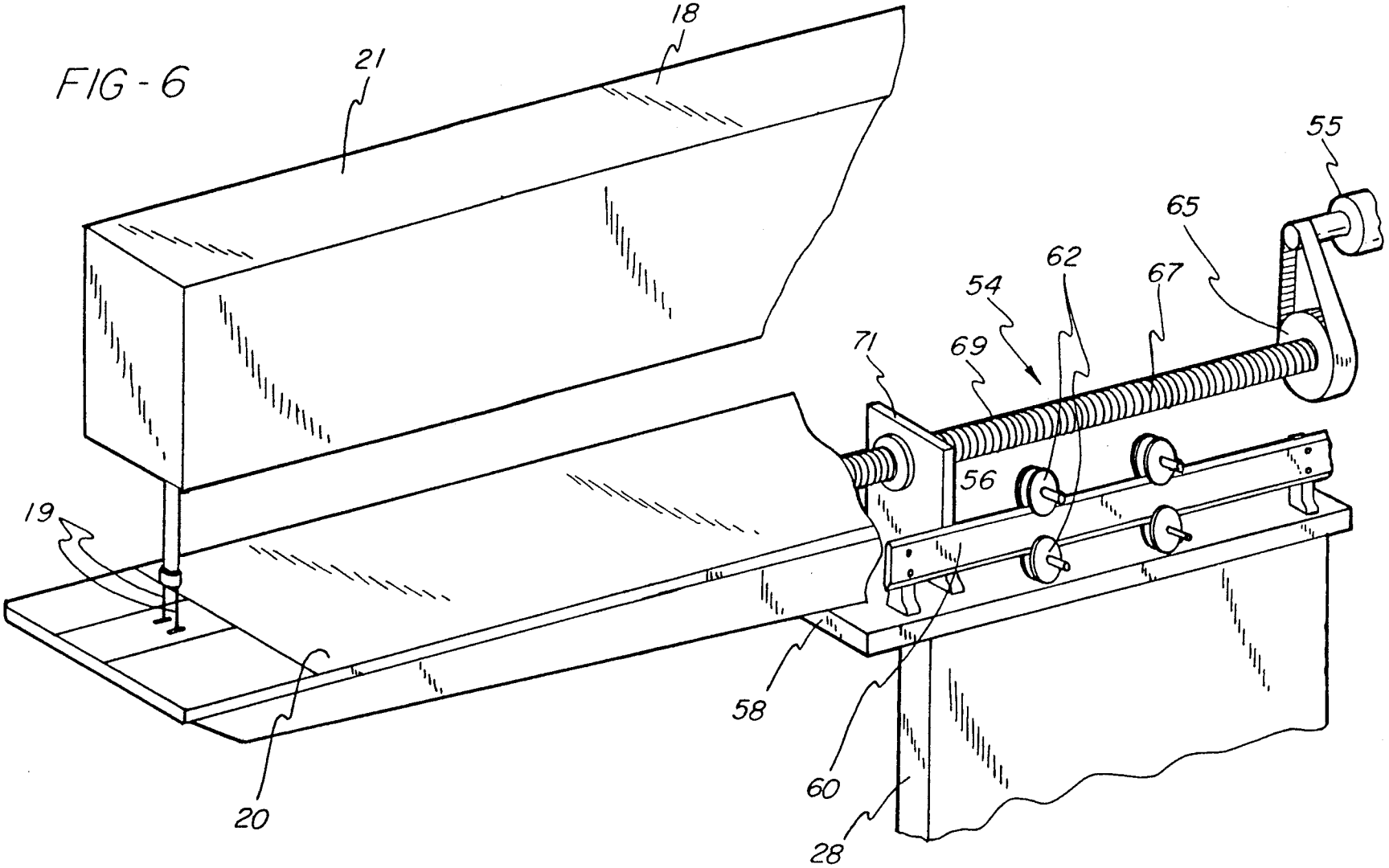
FIG. 6 is a fragmentary view showing more details of the linear motion assembly shown in FIG. 3.

The linear motion assembly 56 also comprises a plurality of rollers 62 which are conventionally secured to the base 20 of the sewing head 18, as shown. The rollers 62 cooperate with the guide rail 60 to permit the sewing head 18 to linearly move between a home position shown in FIG. 1 and a sewing position where the sewing head 18 is operatively positioned at either the first or second sewing stations 40 and 42. One suitable type of slide unit assembly is the Hepco assembly, manufactured by Bishop-Wisecarver of England. The drive means 54 also comprises a drive motor 55 mounted on the sewing head 18. The drive motor 55 is coupled to a timing belt and pulley 65 (FIG. 6) which is coupled to a gear screw assembly 67 which is mounted to the base 20 of the sewing head 18. The drive motor 55 is also coupled to the master controller 16 which can energize the drive motor 55 to cause a stationary gear screw 69 which is rotatably mounted to the base 20 of the sewing head 18 to turn in a gear bolt 71 which is fixed to the planar member 58, thereby causing the sewing head 18 to move linearly. Although the drive means 54 has been shown and described as including the linear motion assembly 56, it could include any suitable means which is capable of permitting the sewing head 18 to move between the home position shown in FIG. 1 and a sewing position where the sewing head 18 is operatively positioned at either the first or second sewing stations 40 and 42.

It should be understood that the master controller 16 is coupled to pivot means 24, drive means 54, solenoids 47 and 51, and the sewing head 18. The master controller 16 is capable of energizing the pivot means 24 to pivot the sewing head 18 in accordance with a program (not shown) into alignment with either the first leg portion 22-1 or the second leg portion 22-2. The master controller 16 is also capable of energizing the drive means 54 to linearly drive the sewing head 18 into operative relationship with either the first or second workpiece supports 36 and 38. Once the sewing head 18 is properly positioned at either the first or second sewing stations 40 and 42, the master controller 16 can energize the sewing head 18 to reciprocate the sewing needles 19 in either the first or second elongated slots 50 or 52, respectively, thereby causing the predetermined stitch pattern 12 to be sewn on the workpiece 14.

A method for sewing workpieces 14 into tubular shapes will now be described. An operator, who may be stationed at an operator station 60 (FIG. 1) between the first and second leg portions 22-1 and 22-2, loads an edge 14-1 (FIG. 4A) of the workpiece 14 against the bump gauge 53 at the second sewing station 42. The operator then causes the master controller 16 to energize the solenoid 51 to pivot the clamp bar 48 and associated fingers 79 to secure the edge 14-1 of the workpiece 14 against the bump gauge 53 and support surface 38, as shown in phantom in FIG. 4A. The operator would then wrap the second edge 14-2 of the workpiece 14 underneath the first workpiece support 38 as shown in FIG. 4A and 4B. The master controller 16 can then energize the solenoid 47 to cause the finger bar 45 to cause the fingers 45-1 to force the edge 14-2 against the edge 14-1 and the support surface 38-1 of the second workpiece support 38. After the first and second edges 14-1 and 14-2 are secured against the surface 38-1, the master controller 16 energizes the solenoid 51 to pivot the clamp bar 48 to retract the fingers 79 away from the edge 14-1 to a non-engaged position, as shown in FIG. 4A. Once the edges 14-1 and 14-2 of the workpiece 14 are secured against the surface 38-1 of the second workpiece support 38, the operator is free to begin loading a second workpiece 14 on the first workpiece support 36. During this time, the master controller 16 energizes drive means 54 to move the sewing head 18 into operative relationship with the second elongated slot 52. It should be appreciated that when the sewing head 18 is operatively related to the second elongated slot 52, the base 20 of the sewing head 18 becomes positioned below the support surface 38-1, and the sewing needles 19 become operatively aligned with the second elongated slot 52. The master controller 16 then energizes the sewing head 18 to reciprocate the sewing needles 19, thereby sewing the predetermined stitch pattern 12 on the workpiece 14 and causing the workpiece 14 to be sewn into a tubular shape.

After the first workpiece 14 is sewn at the second sewing station 42, the master controller 16 energizes drive means 54 to retract the sewing head 18 from the second sewing station 42. The master controller 16 then energizes the pivot means 24 to pivot the sewing head 18 the predetermined arc length D so that the sewing head 18 becomes operationally aligned with the first workpiece support 36 at the first sewing station 40. The method of clamping and sewing the workpiece 14 at the first sewing station 40 would be substantially the same as the method described above for sewing the workpiece 14 at the second sewing station 42. If desired, the angular distance between the first and second leg portions 22-1 and 22-2 can be pivotally adjusted to a new predetermined arc length D (FIG. 1), as mentioned previously herein. The program (not shown) in the master controller 16 would then be programmed to energize the pivot means 24 to pivot the sewing head 18 along the new predetermined arc length D.

Various changes or modifications in the invention described may occur to those skilled in the art without departing from the spirit or scope of the invention. For example, the embodiment being described herein shows only two sewing stations 40 and 42, but there could be more sewing stations if desired. The above description of the invention is intended to be illustrative only and not limiting, and it is not intended that invention be restricted thereto but that it be limited only by the true spirit and scope of the appended claims.

What is claimed is:

1. A sewing system comprising:

a pivotable sewing head;

a first sewing station;

a second sewing station; said first and second sewing stations being angularly displaced at separate points on an arc a predetermined arc length apart;

a support for supporting said pivotable sewing head in operative relationship with said first and second sewing stations;

positioning means secured to said support for pivoting said pivotable sewing head and also for causing relative movement between said pivotable sewing head and said first and second sewing stations so that said pivotable sewing head becomes operatively positioned at either said first sewing station or said second sewing station; and a master controller coupled to said pivotable sewing head and said positioning means, said master controller being capable of energizing said positioning means to cause said pivotable sewing head to be pivoted towards either said first or second sewing station and positioned at either said first sewing station or said second sewing station so that workpieces located at said first or second sewing stations, respectively, may be sewn into tubular shapes.

2. The sewing system as recited in claim 1 wherein said positioning means comprises pivot means for causing said pivotable sewing head to pivot on said support into alignment with either said first sewing station or said second sewing station.

3. The sewing system as recited in claim 2 wherein said pivot means comprises a bottom member and a top member rotatably mounted on said bottom member, said top member pivotally supporting said pivotable sewing head and said bottom member being coupled to said support, said pivot means further comprising a rotational gear located on said top member and also having a drive motor coupled to said bottom member, said drive motor having a drive gear which engages said rotational gear to cause said top member and said pivotable sewing head to pivot with respect to the bottom member.

4. The sewing system as recited in claim 3 wherein said positioning means further comprises moving means for causing said pivotable sewing head to linearly move towards and away from said first and second sewing stations, said moving means comprising a drive motor coupled to said master controller, a gear screw which is mounted to a base of said pivotable sewing head, a gear bolt which is secured to said top member, said gear screw being threadably mounted in said gear bolt, at least one guide rail secured to the top member, and a plurality of guide rollers mounted on the pivotable sewing head for permitting the pivotable sewing head to be slidably mounted on said at least one guide rail; said drive motor being coupled to said gear screw so that when said master controller can energize said drive motor to move said pivotable sewing head towards and away from said first and second sewing stations.

5. The sewing system as recited in claim 4 wherein said first and second sewing stations comprise first and second elongated workpiece support surfaces which are mounted on first and second legs, respectively; said first and second legs being adjustably coupled to said bottom member so as to permit the predetermined arc length to be adjusted.

6. The sewing system as recited in claim 2 wherein said pivot means permits said pivotable sewing head to pivot 360° or less.

7. The sewing system as recited in claim 1 wherein said positioning means comprises moving means for linearly moving said pivotable sewing head into operative relationship with said first and second sewing stations.

8. The sewing system as recited in claim 1 wherein said are faces an imaginary point associated with said pivotable sewing head, said first and second sewing stations comprising first and second elongated workpiece support surfaces, respectively; said first and second elongated support surfaces each having an elongated slot therethrough for permitting an elongated stitch pattern to be sewn on the workpiece located at the first or second sewing station.

9. The sewing system as recited in claim 8 wherein said sewing head comprises a double sewing needle, a base and a horizontal arm;

each of said first and said elongated workpiece support surfaces being positioned between said base and said elongated arm so that said double needle becomes operatively positioned with the elongated slot when said pivotable sewing machine is moved towards said first and second sewing stations, respectively, to permit a dual stitch pattern to be sewn.

10. The sewing system as recited in claim 1 wherein said predetermined arc length is less than 90 degrees.

11. The sewing system as recited in claim 10 wherein said predetermined arc length is 60 degrees.

12. The sewing system as recited in claim 1 wherein said first and second sewing stations comprise:

clamping means for clamping two edges of said workpiece together to form a tubular shape.

13. The sewing system as recited in claim 12 wherein each of said clamping means comprises a clamp bar having a plurality of fingers for engaging at least one edge of said workpiece.

14. A programmable sewing machine comprising:

a first workpiece support having a first elongated slot therein;

a second workpiece support having a second elongated slot therein;

each of said first and second workpiece supports comprising at least one clamp for clamping a workpiece into a tubular shape on either said first workpiece support or said second workpiece support, respectively;

a pivotable sewing head having a sewing needle and a sewing surface operatively related to the sewing needle;

a support for angularly supporting said first and second workpiece supports at two separate points on an arc a predetermined arc length apart and also for locating said first and second workpiece supports a predetermined distance away from said sewing head;

a pivot assembly for causing the pivotable sewing head to pivot towards and away from either the first or second workpiece support; and a driver coupled to said pivotable sewing head and said support for causing said pivotable sewing head to move towards and away from either said first or second workpiece supports so that said sewing needle becomes operatively related to either the first or second elongated slots, respectively, to permit said pivotable sewing head to sew said workpieces into said tubular shape.

15. The programmable sewing machine as recited in claim 14 wherein said support comprises pivot means for causing said pivotable sewing head to pivot about an intersecting point associated with said pivot assembly towards either said first or said second workpiece support.

16. The programmable sewing machine as recited in claim 15 wherein said pivot means includes a bottom member and a top member rotatably mounted on said bottom member; said top member pivotally supporting said sewing head and said bottom member being coupled to said support, said driver slidably securing said pivotable sewing head to said top member to permit said pivotable sewing head to be linearly moved between the intersecting point and the first and second workpiece supports.

17. The programmable sewing machine as recited in claim 16 wherein said driver comprises a drive motor coupled to said master controller, a gear screw which is mounted to a base of said sewing head, a gear bolt which is secured to said top member, said gear screw being threadably mounted in said gear bolt, at least one guide rail secured to the top member, and a plurality of guide rollers mounted on the sewing head for permitting the sewing head to be slidably mounted on said at least one guide rail;

said drive motor being coupled to said gear screw so that said master controller can energize said drive motor to move said sewing head towards and away from said first and second workpiece supports.

18. The programmable sewing machine as recited in claim 16 wherein said top member is generally cylindrical and has a drive gear around its circumference.

19. The programmable sewing machine as recited in claim 18 wherein said pivot means further comprises a servo motor coupled to said bottom portion, said servo motor having a motor drive gear which cooperates with said drive gear to pivot said top portion and said sewing head relative to said bottom portion.

20. The programmable sewing machine as recited in claim 19 wherein said first and second workpiece supports each have one end which is pivotally coupled together to form a general V-shape.

21. A tubular seaming system for stitching workpieces into tubular shapes, said tubular seaming system comprising:

a generally V-shaped frame having a first leg portion and a second leg portion, said first and second leg portions having first ends adjustably joined at an intersecting point and having second ends which are angularly displaced at separate points on an arc a predetermined arc length apart;

a first workpiece support located on said first leg portion;

a second workpiece support located on said second leg portion;

a pivotable sewing head having a base;

pivot means for pivotally coupling said base of said pivotable sewing head to said V-shaped frame at said intersecting point and also for pivoting said pivotable sewing head towards either said first leg portion or said second leg portion;

drive means coupled to said pivotable sewing head and said pivot means for linearly driving said pivotable sewing head into and out of operative relationship with said first and second workpiece supports to cause said sewing head to sew elongated stitch patterns on said first and second workpieces;

a master controller coupled to said pivotable sewing head, said pivot means and said drive means for energizing said pivot means to pivot said pivotable sewing head towards said first leg portion or said second leg portion and also for energizing said drive means to linearly drive said sewing head into operative relationship with said first and second workpiece support in order to sew the workpiece into a tubular shape.

22. The tubular seaming system as recited in claim 21 wherein said drive means comprises a linear motion assembly comprising:

a rail coupled to said pivot means;

a plurality of rollers coupled to said base of said pivotable sewing head, said plurality of rollers permitting said pivotable sewing head to be slidably mounted on said rail so that said drive means can linearly drive said pivotable sewing head into and out of operative relationship with said first and second workpiece supports.

23. The tubular seaming system as recited in claim 21 wherein said pivot means includes a bottom member coupled to said generally V-shaped frame at said intersecting point and a top member rotatably mounted on said bottom member.

24. The tubular seaming system as recited in claim 23 wherein said top member is generally cylindrical and has a motor drive gear therearound.

25. The tubular seaming system as recited in claim 24 wherein said pivot means further comprises a servo motor coupled to said bottom member, said servo motor having a drive gear which cooperates with said motor drive gear to pivot said top member and said pivotable sewing head.

26. The tubular seaming system as recited in claim 21 wherein said first and second workpiece supports each comprise:

clamping means located at each of said first and second workpiece support stations for clamping two edges of said workpiece together to form a tubular shape.

27. The tubular seaming system as recited in claim 26 wherein each of said clamping means comprises a clamp bar having a plurality of fingers for engaging at least one edge of said workpiece.

28. A method for sewing workpieces into tubular shapes, said method comprising the steps of:

(a) positioning a workpiece at either a first workpiece support station or a second workpiece support station; said first and second workpiece support stations being located on an arc a predetermined arc length apart;

(b) clamping a first edge of the workpiece onto a second edge of the workpiece to form a tubular shape first workpiece support member being secured to a first leg portion which is pivotally secured to a second leg portion having a second workpiece support member secured thereto, said first and second workpiece support members being pivotally secured together to provide a V-shaped;

(c) pivoting a sewing head into alignment with whichever of the first or second workpiece support stations has the workpiece clamped thereat;

(d) driving said sewing head into operative relationship with said workpiece; and (e) sewing said first and second edges of said workpiece together.

29. The method as recited in claim 28 in which said method further comprises the steps of:

(f) positioning a second workpiece at the other of said first or second workpiece support stations;

(g) repeating steps (b)–(e) for the second workpiece.

30. The method as recited in claim 29 in which said repeating step (f) is begun at the completion of said clamping step (b).

31. The method as recited in claim 28 wherein said loading step (a) further comprises the step of:

(a) (1) adjusting said predetermined arc length.

* * * * *

UNITED STATES PATENT AND TRADEMARK OFFICE

CERTIFICATE OF CORRECTION

PATENT NO. : 5,163,376
DATED : November 17, 1992
INVENTOR(S) : Ricky J. Frye

It is certified that error appears in the above-indentified patent and that said Letters Patent is hereby corrected as shown below:

Title page, item [57] Abstract, line 4, "reltionship" should be --relationship--.

Column 7, Claim 8, line 55, "are" should be --are--.

Column 10, Claim 28, lines 39-44, "first workpiece support member ... a V-shaped" should be deleted.

Signed and Sealed this

Nineteenth Day of October, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,163,376
DATED : November 17, 1992
INVENTOR(S) : Ricky J. Frye

It is certified that error appears in the above-indentified patent and that said Letters Patent is hereby corrected as shown below:

On the Title page, item [57], Abstract, line 4, "reltionship" should be --relationship--.

Column 7, Claim 8, line 55, "are" should be --arc--.

Column 10, Claim 28, lines 39-44, "first workpiece support member ... a V-shaped" should be deleted--.

This certificate supersedes Certificate of Correction issued October 19, 1993.

Signed and Sealed this

Eleventh Day of January, 1994

*Attest:*

Bruce Lehman

BRUCE LEHMAN

*Attesting Officer*

*Commissioner of Patents and Trademarks*